US009812139B2

(12) United States Patent
Chen et al.

(10) Patent No.: US 9,812,139 B2
(45) Date of Patent: Nov. 7, 2017

(54) METHOD, TERMINAL, SYSTEM FOR AUDIO ENCODING/DECODING/CODEC

(71) Applicant: TENCENT TECHNOLOGY (SHENZHEN) COMPANY LIMITED, Shenzhen (CN)

(72) Inventors: Guoming Chen, Shenzhen (CN); Yuanjiang Peng, Shenzhen (CN); Wenjun Ou, Shenzhen (CN); Hong Liu, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 194 days.

(21) Appl. No.: 14/596,753

(22) Filed: Jan. 14, 2015

(65) Prior Publication Data

US 2015/0127356 A1 May 7, 2015

Related U.S. Application Data

(63) Continuation of application No. PCT/CN2014/082888, filed on Jul. 24, 2014.

(30) Foreign Application Priority Data

Aug. 20, 2013 (CN) ..... 2013 1 0364530

(51) Int. Cl.
*G10L 21/00* (2013.01)
*G10L 25/93* (2013.01)
(Continued)

(52) U.S. Cl.
CPC ..... *G10L 19/02* (2013.01); *G10L 19/032* (2013.01); *G10L 25/09* (2013.01); *G10L 25/21* (2013.01)

(58) Field of Classification Search
USPC ..... 704/208, 210, 213–215, 500–502
See application file for complete search history.

(56) References Cited

U.S. PATENT DOCUMENTS 7,542,896 B2 * 6/2009 Schuijers ..... G10L 19/008 704/201
8,521,529 B2 * 8/2013 Goodwin ..... G10L 15/04 360/13
(Continued)

FOREIGN PATENT DOCUMENTS

CN 101647059 A 2/2010
CN 101894558 A 11/2010
(Continued)

OTHER PUBLICATIONS

Lu et al, "Content Analysis for Audio Classification and Segmentation", 2002, In IEEE Transactions on Speech and Audio Processing, vol. 10, No. 7, Oct. 2002, pp. 504-516.*
(Continued)

*Primary Examiner* — Olujimi Adesanya
(74) *Attorney, Agent, or Firm* — Anova Law Group, PLLC

(57) ABSTRACT

Audio encoding methods/terminals, audio decoding methods/terminals, and audio codec systems are provided. A plurality of audio signals that are continuous is obtained. It is determined whether each audio signal of the plurality of audio signals includes a designated signal type, according to an audio parameter of each audio signal. A marked audio encoding stream is obtained by performing a marking to each audio signal as having or not having the designated signal type. The marking is used, at a decoding terminal, to perform an enhancement-process to one or more audio signals having the designated signal type. The enhancement-process is not performed to audio signals that do not have the designated signal type.

21 Claims, 9 Drawing Sheets

(51) Int. Cl.

| | |
|---|---|
| ***G10L 19/00*** | (2013.01) |
| ***H04H 20/47*** | (2008.01) |
| ***H04H 20/88*** | (2008.01) |
| ***G10L 19/02*** | (2013.01) |
| *G10L 19/032* | (2013.01) |
| *G10L 25/21* | (2013.01) |
| *G10L 25/09* | (2013.01) |

(56) References Cited

U.S. PATENT DOCUMENTS 8,856,049 B2 * 10/2014 Vasilache ..... G10L 25/78 704/205
2005/0096898 A1 * 5/2005 Singhal ..... G10H 1/125 704/205
2005/0102135 A1 * 5/2005 Goronzy ..... G10L 15/00 704/213
2006/0067512 A1 * 3/2006 Boillot ..... H04M 1/6033 379/388.04
2007/0002971 A1 * 1/2007 Purnhagen ..... G10L 19/008 375/316
2007/0165869 A1 * 7/2007 Ojanpera ..... G10L 19/008 381/23
2007/0168183 A1 * 7/2007 Van De Kerkhof .. G10L 19/008 704/200.1
2007/0271093 A1 * 11/2007 Wang ..... G10L 25/78 704/210
2009/0006103 A1 * 1/2009 Koishida ..... G10L 19/167 704/500
2010/0004926 A1 * 1/2010 Neoran ..... G10L 25/48 704/201
2010/0153118 A1 * 6/2010 Hotho ..... G10L 19/008 704/500
2010/0310081 A1 * 12/2010 Lien ..... G10L 19/008 381/22
2011/0016077 A1 * 1/2011 Vasilache ..... G10L 25/78 706/52
2011/0112829 A1 * 5/2011 Lee ..... G10L 19/20 704/205
2012/0095769 A1 * 4/2012 Zhang ..... G10L 19/008 704/500
2012/0121091 A1 * 5/2012 Ojanpera ..... G10L 19/008 381/2
2013/0058488 A1 * 3/2013 Cheng ..... G10L 25/81 381/56
2013/0322633 A1 * 12/2013 Stone ..... H04S 3/00 381/2
2014/0039890 A1 * 2/2014 Mundt ..... G10L 19/167 704/236
2016/0078879 A1 * 3/2016 Lu ..... G10L 25/81 381/56

FOREIGN PATENT DOCUMENTS

CN 101965612 A 2/2011
CN 102007534 A 4/2011
CN 103000172 A 3/2013

OTHER PUBLICATIONS

Schuijers et al, "Advances in Parametric Coding for High-Quality Audio" 2003, In Audio Engineering Society Convention Paper Presented at the 114th Convention Mar. 22-25, 2003 Amsterdam, pp. 1-11.*
Krishnamoorthy et al, "Hierarchical audio content classification system using an optimal feature selection algorithm" 2011, In . Multimed. Tools Appl. 54:415-444.*
Hu et al, "Combining frame and segment based models for environmental sound classification", 2012, 13th Annual Conference of the International Speech Communication Association, pp. 1-4.*
Virette et al., "G.722 annex D and G.711.1 Annex F—New ITU-T stereo codecs," 2013, IEEE International Conference on Acoustics, Speech and Signal Processing, Vancouver, BC, 2013, pp. 528-532.*

* cited by examiner

METHOD, TERMINAL, SYSTEM FOR AUDIO ENCODING/DECODING/CODEC

CROSS-REFERENCES TO RELATED APPLICATIONS

This application is a continuation application of PCT Patent Application No. PCT/CN2014/082888, filed on Jul. 24, 2014, which claims priority to Chinese Patent Application No. 201310364530X, filed on Aug. 20, 2013, the entire content of which is incorporated herein by reference.

FIELD OF THE DISCLOSURE

The present disclosure generally relates to the field of network technology and, more particularly, relates to audio encoding methods, audio decoding methods, encoding terminals, decoding terminals, and audio codec systems.

BACKGROUND

Audio enhancement technology is often used for processing audio signal. The audio enhancement technology may include echo, reverb, acoustic-image expansion, equalization, and 3D surround.

Conventional audio enhancement technology generally uses modules to process an audio signal in a time domain or in a frequency domain after certain conversions. However, simply performing the enhancement-process to the audio signal in the time domain does not provide optimal effect, while performing the enhancement-process to the converted audio signal in the frequency domain increases additional computational complexity due to the time/frequency domain transformation.

Conventional solutions include performing a codec-process to the audio signal, followed by an enhancement-process to provide certain effect with reduced amount of computation. However, quantization noises cannot be avoided during the codec-process of the audio signal. When an audio signal undergoes an enhancement-process, quantization noises can also be increased. This can adversely affect sensing of the audio signals.

BRIEF SUMMARY OF THE DISCLOSURE

One aspect or embodiment of the present disclosure includes an audio encoding method. A plurality of audio signals that are continuous is obtained. It is determined whether each audio signal of the plurality of audio signals includes a designated signal type, according to an audio parameter of each audio signal. A marked audio encoding stream is obtained by performing a marking to each audio signal as having or not having the designated signal type. The marking is used, at a decoding terminal, to perform an enhancement-process to one or more audio signals having the designated signal type. The enhancement-process is not performed to audio signals that do not have the designated signal type.

Another aspect or embodiment of the present disclosure includes an audio decoding method by obtaining an audio encoding stream after a marking that is performed to each audio signal of a plurality of audio signals as having or not having a designated signal type. The plurality of audio signals from the audio encoding stream and the marking of at least a portion of the plurality of audio signals are obtained. An enhancement-process is performed to one or more audio signals having the designated signal type according to the marking, to obtain an enhanced audio signal. The enhanced audio signal is added into a decoding stream of the plurality of audio signals to obtain an audio decoding signal.

Another aspect or embodiment of the present disclosure includes an audio decoding method by obtaining an audio encoding stream to be decoded. A plurality of audio signals that are continuous and an audio parameter of each audio signal, from the audio encoding stream are obtained. It is determined whether each audio signal includes a designated signal type, according to an audio parameter of each audio signal. An enhancement-process is performed to one or more audio signals having the designated signal type to obtain one or more enhanced audio signals. The one or more enhanced audio signals are added into a decoding stream of the plurality of audio signals to obtain an audio decoding signal.

Another aspect or embodiment of the present disclosure includes an audio encoding apparatus. The encoding apparatus includes a signal obtaining module, a first determining module, and a marking module. The signal obtaining module is configured to obtain a plurality of audio signals that are continuous. The first determining module is configured to determine whether each audio signal obtained by the signal obtaining module includes a designated signal type, according to an audio parameter of each audio signal. The marking module is configured to perform a marking to each audio signal as having or not having the designated signal type determined by the first determining module to obtain a marked audio encoding stream. The marking is used, when decoding, to perform an enhancement-process to one or more audio signals having the designated signal type.

Another aspect or embodiment of the present disclosure includes an audio decoding apparatus. The audio decoding apparatus includes a first obtaining module, a marking obtaining module, a first enhancing module, and a first adding module. The first obtaining module is configured to obtain an audio encoding stream after a marking that is performed to each audio signal of a plurality of audio signals as having or not having a designated signal type. The marking obtaining module is configured to obtain the plurality of audio signals from the audio encoding stream obtained by the first obtaining module and to obtain the marking of at least a portion of the plurality of audio signals. The first enhancing module is configured to perform an enhancement-process to one or more audio signals having the designated signal type according to the marking obtained by the marking obtaining module, to obtain an enhanced audio signal. The first adding module is configured to add the enhanced audio signal from the first enhancing module into a decoding stream of the plurality of audio signals to obtain an audio decoding signal.

Another aspect or embodiment of the present disclosure includes an audio decoding apparatus. The audio decoding apparatus includes a first obtaining module, a second obtaining module, a first determining module, a first enhancing module, and a first adding module. The first obtaining module is configured to obtain an audio encoding stream to be decoded. The second obtaining module is configured to obtain, a plurality of audio signals that are continuous and an audio parameter of each audio signal, from the audio encoding stream obtained by the first obtaining module. The first determining module is configured to determine whether each audio signal includes a designated signal type, according to the audio parameter of each audio signal obtained by the second obtaining module. The first enhancing module is configured to perform an enhancement-process to one or more audio signals having the designated signal type determined by the first determining module to obtain one or more enhanced audio signals. The first adding module is configured to add the one or more enhanced audio signals enhanced by the first enhancing module into a decoding stream of the plurality of audio signals to obtain an audio decoding signal.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 1:
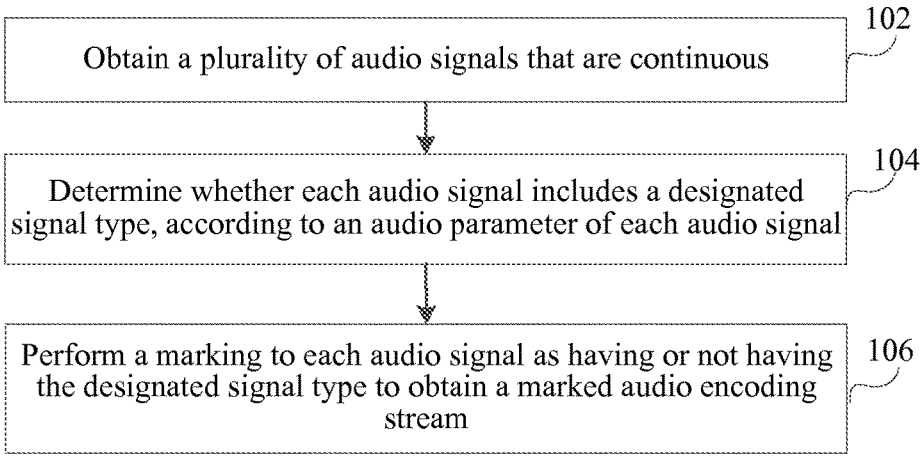
FIG. 1 depicts an exemplary audio encoding method consistent with various disclosed embodiments.

FIGS. 1-13 depict exemplary audio encoding methods, audio decoding methods, encoding terminals, decoding terminals, and audio codec systems consistent with various disclosed embodiments. FIG. 1 depicts an exemplary audio encoding method consistent with various disclosed embodiments.

In Step 102, continuous audio signals can be obtained. The encoding terminal obtains a plurality of audio signals that are continuous.

In Step 104, according to an audio parameter of each audio signal, it is determined whether each audio signal includes a designated signal type. The encoding terminal determines whether each audio signal includes a designated signal type according to an audio parameter of each audio signal.

In Step 106, a marking can be performed to each audio signal as having or not having the designated signal type to obtain a marked audio encoding stream.

The encoding terminal performs a marking to each audio signal which may have or not have the designated signal type to obtain a marked audio encoding stream. For example, if the audio signal does not have the designated signal type, the audio signal can be marked as not having the designated signal type. If the audio signal has the designated signal type, the audio signal can be marked accordingly as having the designated signal type. Such marking can be used to perform an enhancement-process at a decoding terminal to one or more audio signals having the designated signal type.

In the disclosed audio encoding method, the audio parameter of each audio signal can be used to determine whether each audio signal includes the designated signal type, and each audio signal can thus be marked as having or not having the designated signal type to provide a marked audio encoding stream. The marking is used for the decoding terminal to perform an enhancement-process to one or more audio signals having the designated signal type.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain.

Figure 2:
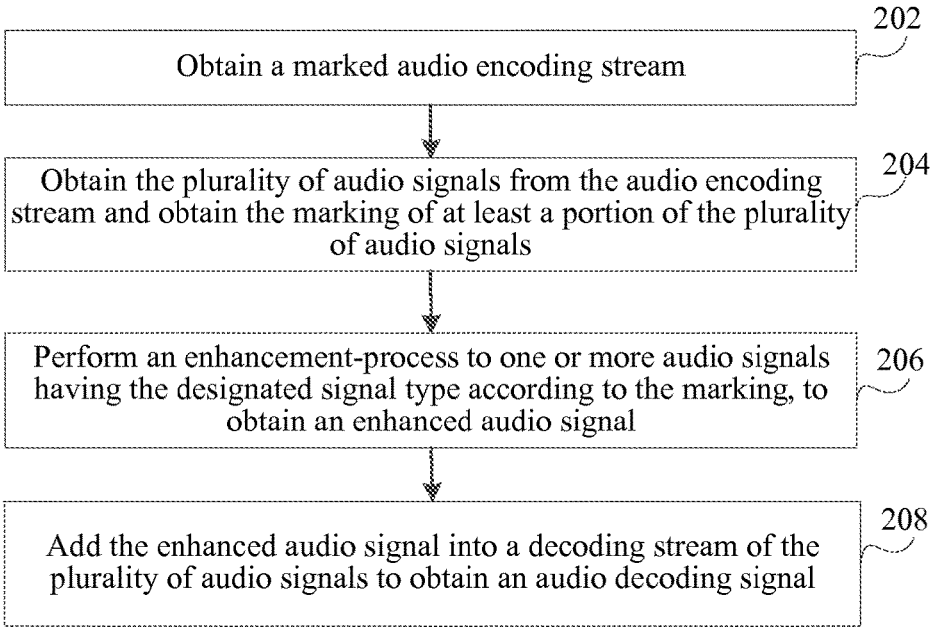
FIG. 2 depicts an exemplary audio decoding method consistent with various disclosed embodiments.

FIG. 2 depicts an exemplary audio decoding method consistent with various disclosed embodiments.

In Step 202, a marked audio encoding stream can be obtained. The decoding terminal obtains a marked audio encoding stream. The marking is performed at the encoding terminal when marking each audio signal of a plurality of audio signals as having or not having a designated signal type.

In Step 204, the plurality of audio signals can be obtained from the marked audio encoding stream. The marking of a portion or all of the plurality of audio signals can also be obtained. The decoding terminal obtains the plurality of audio signals from the marked audio encoding stream and obtains the marking of a portion or all of the plurality of audio signals. In Step 206, an enhancement-process can be performed to one or more audio signals having the designated signal type according to the marking to obtain an enhanced audio signal.

The decoding terminal performs an enhancement-process to one or more audio signals having the designated signal type according to the marking, to obtain an enhanced audio signal. In Step 208, the enhanced audio signal can be added into a decoding stream of the plurality of audio signals to obtain an audio decoding signal.

The decoding terminal adds the enhanced audio signal into a decoding stream of the plurality of audio signals to obtain an audio decoding signal.

In the disclosed audio decoding method, by obtaining a plurality of audio signals and marking of a portion or all of the plurality of audio signals from the marked audio encoding stream, an enhancement-process can be performed to one or more audio signals having the designated signal type according to the marking. An enhanced audio signal can then be obtained and added into a decoding stream of the plurality of audio signals to obtain an audio decoding signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain.

Figure 3:
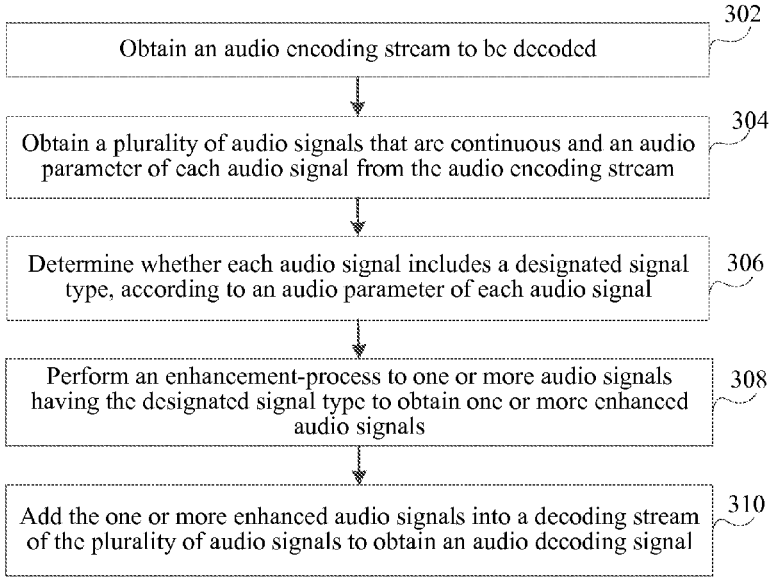
FIG. 3 depicts another exemplary audio decoding method consistent with various disclosed embodiments.

FIG. 3 depicts another exemplary audio decoding method consistent with various disclosed embodiments. In Step 302, an audio encoding stream to be decoded can be obtained. The decoding terminal obtains an audio encoding stream to be decoded.

In Step 304, a plurality of audio signals that are continuous and an audio parameter of each audio signal can be obtained from the audio encoding stream. The decoding terminal obtains continuous multiple audio signals and an audio parameter of each audio signal from the audio encoding stream.

In Step 306, according to an audio parameter of each audio signal, it is determined whether each audio signal includes a designated signal type. The decoding terminal determines whether each audio signal includes a designated signal type, according to an audio parameter of each audio signal.

In Step 308, an enhancement-process can be performed to one or more audio signals having the designated signal type to obtain one or more enhanced audio signals. The decoding terminal performs an enhancement-process to one or more audio signals having the designated signal type to obtain one or more enhanced audio signals.

In Step 310, the one or more enhanced audio signals can be added into a decoding stream of the plurality of audio signals to obtain an audio decoding signal. The decoding terminal adds the one or more enhanced audio signals into a decoding stream of the plurality of audio signals to obtain an audio decoding signal.

In the disclosed audio decoding method, continuous multiple audio signals and an audio parameter of each audio signal can be obtained from the audio encoding stream. It is then determined whether each audio signal includes a designated signal type according to an audio parameter of each audio signal. An enhancement-process can be performed to one or more audio signals having the designated signal type to obtain one or more enhanced audio signals. The one or more enhanced audio signals can be added into a decoding stream of the multiple audio signals to obtain an audio decoding signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain.

To enhance the audio signal, various audio encoding/decoding systems are provided. In one embodiment for an audio encoding/decoding system, the encoding terminal and the decoding terminal are cooperated to selectively process the enhancement-process to the audio signal. The encoding terminal contains content determination logic to determine whether an enhancement-process is needed according to the audio parameter of the audio signal, as shown in FIGS. 4*a*-4*b*.

Figure 5A:
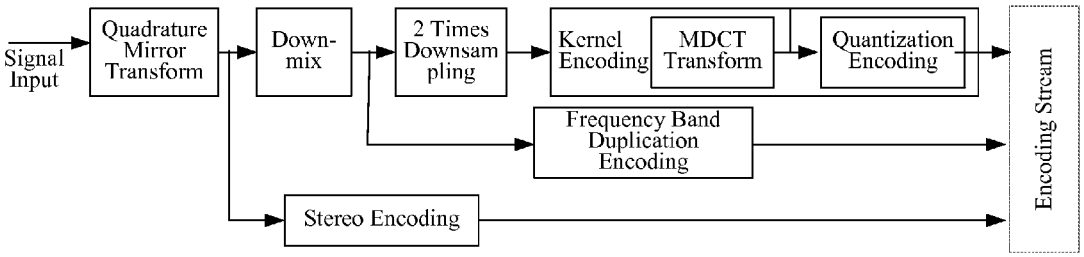
FIG. 5*a* depicts logic for another exemplary audio enhancement method at an encoding terminal consistent with various disclosed embodiments.
Figure 5B:
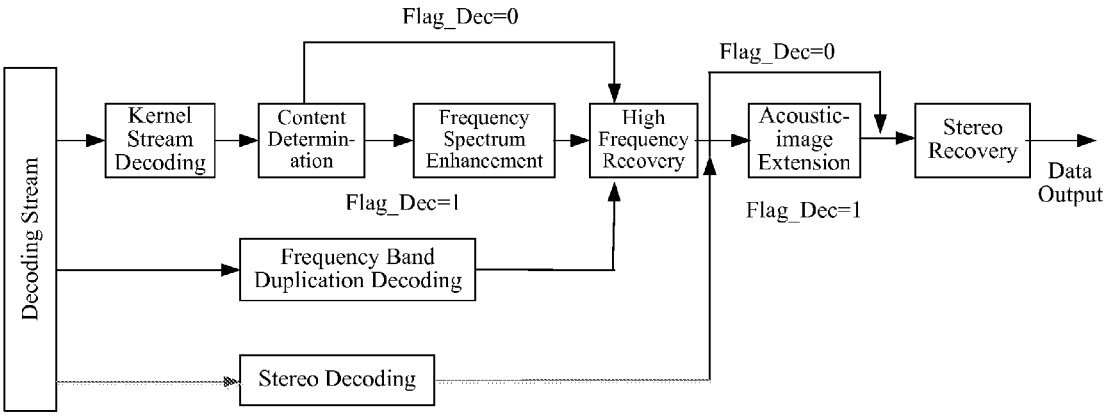
FIG. 5*b* depicts logic for another exemplary audio enhancement method at a decoding terminal consistent with various disclosed embodiments.

In another embodiment for an audio encoding/decoding system, only the decoding terminal is used to selectively process the enhancement-process to the desired audio signals. The decoding terminal contains the content determination logic to determine whether the enhancement-process needs to be performed, according to the audio parameter of the audio signal, as shown in FIGS. 5*a*-5*b*.

Figure 4A:
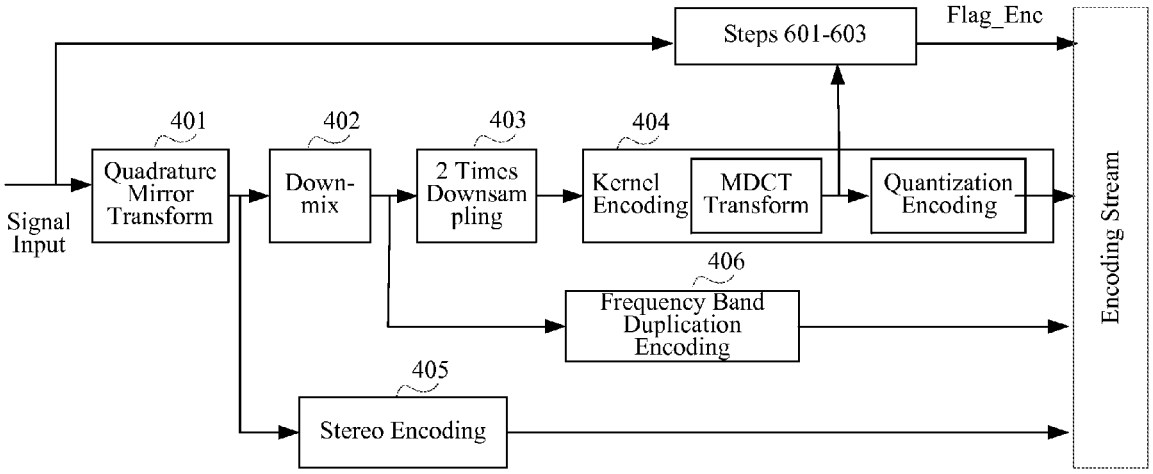
FIG. 4*a* depicts logic for an exemplary audio enhancement method at an encoding terminal consistent with various disclosed embodiments.
Figure 4B:
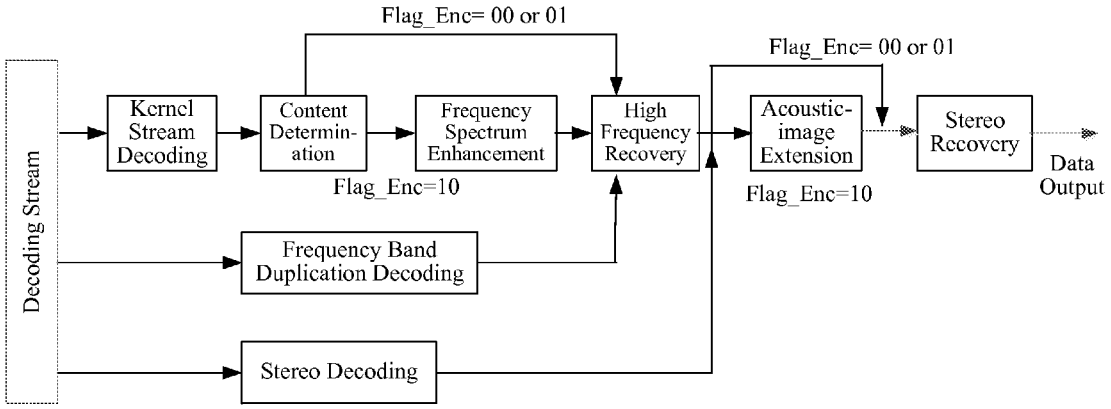
FIG. 4*b* depicts logic for an exemplary audio enhancement method at a decoding terminal consistent with various disclosed embodiments.
Figure 6:
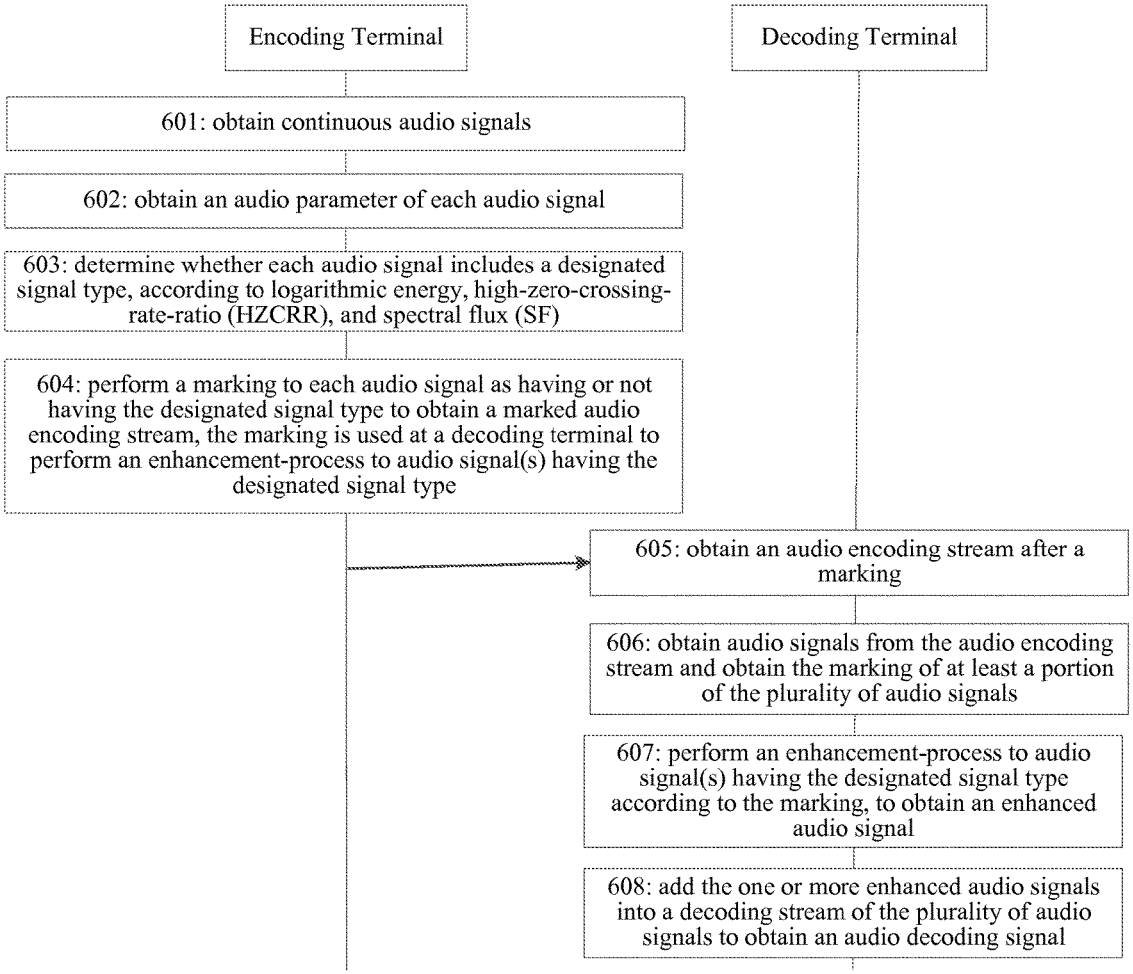
FIG. 6 depicts an exemplary audio enhancement method for FIGS. 4*a*-4*b* consistent with various disclosed embodiments.

FIG. 6 depicts an exemplary audio enhancement method according to an embodiment shown in FIGS. 4*a*-4*b* consistent with various disclosed embodiments. In Step 601, the encoding terminal obtains continuous, multiple audio signals.

To realize the enhancement-process to the audio signal, the encoding terminal needs to process encoding to the audio signal in a time domain. In an exemplary embodiment, one audio signal may have length, e.g., including about 960 sites. The encoding terminal obtains the continuous, multiple audio signals in the time domain. Referring to FIG. 4*a*, the inputted signal can be a sampling site value x(n) of the exemplary 960 sampling sites of the audio signal.

In Step 602, the encoding terminal obtains an audio parameter of each audio signal. The audio parameter of each audio signal can include, e.g., logarithmic energy, a high-zero-crossing-rate-ratio (HZCRR), and a spectral flux (SF). The logarithmic energy, the high-zero-crossing-rate-ratio (HZCRR), and the spectral flux (SF) can be extracted by a content determination module in FIG. 4*b*.

The encoding terminal obtains the logarithmic energy and the high-zero-crossing-rate-ratio (HZCRR) directly according to the site value x(n) of the 960 sampling sites of each audio signal. According to the frequency domain signal X(n) obtained from MDCT (Modified Discrete Cosine Transform) conversion, the encoding terminal obtains the spectral flux (SF) of the audio signal.

Specifically, the time domain energy of an $^{i}$th audio signal is defined as:

$$E(i)=\Sigma_{n=(i-1)*L}^{i*L-1}x^2(n),$$

and the logarithmic energy of the $^{i}$th audio signal is defined as:

$$E_{log}(i)=\log_2(E(i)),$$

where x(n) denotes the site value of the $^{n}$th sampling sites of the $^{i}$th audio signal, L denotes a length (or a frame length) of the audio signal. e.g., L=960, and n is about 0 to about 959.

The zero-crossing-rate(i), ZCR(i) of the $^{i}$th audio signal is defined as:

$$ZCR(i) = \sum_{n=(j-1)*L}^{j*L-1} \frac{[\text{sign}(x(n)) - \text{sign}(x(n-1))]}{2},$$

where sign(x) is a sign function and defined as:

$$\text{sign}(x) = \begin{cases} 1, & x \geq 0 \\ -1, & x < 0 \end{cases}.$$

The high-zero-crossing-rate-ratio (HZCRR) of the $^{i}$th audio signal is defined as:

$$HZCRR = \frac{1}{2N} \sum_{n=0}^{N-1} [\text{sign}(ZCR(n) - 1.5avZCR) + 1],$$

where avZCR(i) is the average-zero-crossing-rate of the $^{n}$th audio signal, N=25:

$$avZCR(i) = \frac{1}{N} \sum_{n=0}^{N-1} ZCR(n).$$

The spectral flux (SF) is defined as the spectral average variance of two adjacent audio signals:

$$SF(i) = \frac{1}{N} \sum_{k=0}^{N-1} [\log(|X(i,k)| + \text{delta}) - \log(|X(i-1,k)| + \text{delta})]^2$$

where X(i, k) is a frequency spectrum coefficient of an $i^{th}$ signal, k is a subscript of the frequency spectrum coefficient, and delta is a relatively low number, e.g., delta=0.0001.

In Step 603 of FIG. 6, the encoding terminal determines whether each audio signal includes a designated signal type, according to the logarithmic energy, the high-zero-crossing-rate-ratio (HZCRR), and the spectral flux (SF).

The designated signal type can be an analogous audio signal. Audio signals that are not an analogous audio signal can include a mute signal and a voice signal.

It is determined that an audio signal is the analogous audio signal, when the logarithmic energy of the audio signal is no less than a first threshold value, the HZCRR is no more than a second threshold value, and the spectral flux is more than a third threshold value.

For example, when the logarithmic energy of the $^{i}$th audio signal is no less than a specific threshold Thr (that is, less than 0), the HZCRR of the $^{i}$th audio signal is no more than 0.2, and the spectral average variance of the $^{i}$th audio signal and the i−1th audio signal (that is, the spectral flux of the $^{i}$th audio signal) is more than 20, the $^{i}$th audio signal is determined to be the analogous audio signal.

An exemplary process can be used to determine an audio signal as following. Firstly, it is determined whether the logarithmic energy of the audio signal is less than the first threshold value. When the logarithmic energy of the audio signal is less than the first threshold value (e.g., the first threshold value can be 0), the audio signal can be determined to be the mute signal. When the logarithmic energy of the audio signal is no less than the first threshold value, determination continues whether the HZCRR is more than the second threshold value and the second threshold value can be 0.2.

When the HZCRR of the audio signal is determined to be more than the second threshold value, the audio signal is determined to be the voice signal. When the HZCRR of the audio signal is determined not to be more than the second threshold value, determination for whether the spectral flux is more than the third threshold value and the third threshold value can be 20 continues.

When the spectral flux of the audio signal is more than the third threshold value, the audio signal is determined to be the analogous audio signal.

In Step 604, the encoding terminal can mark each audio signal as having or not having the designated signal type to obtain a marked audio encoding stream. Such marking can be used at the decoding terminal to perform an enhancement-process to one or more audio signals having the designated signal type.

For example, the encoding terminal can first mark each audio signal as having or not having the designated signal type and then process encoding to the marked audio signal.

In one embodiment when marking each audio signal as having or not having the designated signal type, a first marking is performed to the audio signal(s) of the analogous audio signal. No marking can be performed to the audio signal(s) of non-analogous audio signal. For example, when using one bit to mark the audio signal, the analogous audio signal(s) from the audio signals can be marked as 1 or 0. For non-analogous audio signal(s), no bit can be added to the audio signal. As such, when decoding, the decoding terminal can determine whether an enhancement-process needs to be performed to the audio signal, based on whether any bit is contained.

Alternatively, in another embodiment when marking each audio signal as having or not having the designated signal type, a first marking is performed to the audio signal(s) of the analogous audio signal, while other markings can be performed to non-analogous audio signal(s). For example, a second marking can be performed to the mute signal(s) (non-analogous audio signal), and a third marking can be performed the voice signal (non-analogous audio signal). In an example when using one bit to mark the audio signal(s), the analogous audio signal(s) can be marked as 1, while marking the non-analogous audio signal(s) as 0. Alternatively, two bits can be used to mark the audio signal(s). The analogous audio signal(s) can be marked as 10, while marking the audio signal(s) of the mute signal as 00 and marking the audio signal(s) of the voice signal as 10. In this manner, the decoding terminal determines whether an enhancement-process needs to be performed to the audio signal(s) according to the markings.

Still alternatively, in another embodiment when marking each audio signal as having or not having the designated signal type, no marking is performed to the audio signal(s) of the analogous audio signal, while other markings can be performed to the audio signal(s) of non-analogous audio signal. For example, a second marking can be performed to the audio signal(s) of the mute signal (non-analogous audio signal), while a third marking can be performed to the audio signal(s) of the voice signal. For example, when using one bit to mark the audio signal(s), no marking is performed to the audio signal(s) of the analogous audio signal, while the audio signal of non-analogous audio signal can be marked as 1 or 0. As such, when decoding, the decoding terminal can determine whether an enhancement-process needs to be performed to the audio signal, based on whether any bit is contained.

It should be noted that, the present disclosure uses two bits to mark the analogous audio signal, the mute signal, and the voice signal as examples (that is, marking the analogous audio signal as 10, marking the mute signal as 00, and marking the voice signal as 01) to illustrate that the decoding terminal determines whether an enhancement-process needs to be performed to the audio signal, based on the markings. Other suitable marking methods can also be encompassed according to various embodiments.

Referring to FIG. 4*a*, when performing encoding to the marked audio signal, the following exemplary steps can be performed.

In Step 401, the encoding terminal uses the audio signal as an inputted signal to process quadrature mirror transform and to obtain the audio signal after the quadrature-mirror-transform. In Step 402, the encoding terminal processes down-mix to the audio signal after quadrature-mirror-transform to obtain the audio signal after the down-mix.

In Step 403, the encoding terminal processes the 2-time-downsampling to the audio signal after down-mix to obtain the audio signal after the 2-time-downsampling. In Step 404, the encoding terminal processes the kernel encoding to the audio signal after 2-time-downsampling to obtain quantization encoding signal of the audio signal. For example, the kernel encoding includes MDCT transform and the quantization encoding process. The encoding terminal can add the quantization encoding signal obtained after quantization encoding into the encoding stream of the audio signal.

In Step 405, the encoding terminal processes the stereo encoding to the audio signal after quadrature-mirror-transform to obtain a stereo encoding parameter, which can be added into the encoding stream of the audio signal. In Step 406, the encoding terminal processes frequency band duplication encoding to the audio signal after the down-mix to obtain a frequency band duplication encoding parameter, which can then be added into the encoding stream of the audio signal.

In this manner, the audio encoding stream having the markings, the quantization encoding signal, the stereo encoding parameter, and the frequency band duplication encoding parameter can be obtained.

Note that the exemplary Steps 601-604 can be implemented separately for an audio encoding method at the encoding terminal.

In Step 605, the decoding terminal obtains marked audio encoding stream. The marking is performed to each audio signal of a plurality of audio signals as having or not having a designated signal type by the encoding terminal.

For example, the decoding stream in FIG. 4*b* can be the marked audio encoding stream obtained by the decoding terminal. The audio encoding stream contains the markings performed to each audio signal of a plurality of audio signals as having or not having a designated signal type by the decoding terminal.

In Step 606, the decoding terminal obtains the plurality of audio signals from the marked audio encoding stream and obtaining the marking(s) of at least a portion of the plurality of audio signals.

When the encoding terminal processes a first marking to the audio signal(s) of analogous audio signal and processes other marking to the audio signal(s) of non-analogous audio signal, the decoding terminal obtains a plurality of audio signals from the audio stream and all of the markings of the audio signals.

For example, the encoding terminal can mark the analogous audio signal as 10, mark the mute signal as 00, and mark the voice signal as 01. The decoding terminal can then obtain a plurality of audio signals from the audio stream and all of the markings of the audio signals.

When the encoding terminal processes a first marking to the audio signal(s) of analogous audio signal and processes other marking to the audio signal(s) of non-analogous audio signal, or the encoding terminal processes no marking to the audio signal(s) of the analogous audio signal, and processes other markings to the audio signal(s) of non-analogous audio signal, the decoding terminal obtains a plurality of audio signals from the audio stream and all of the markings of the audio signals.

For example, when the encoding terminal marks the audio signal of the analogous audio signal as 1 or 0, then the decoding terminal obtains a plurality of audio signals from the audio stream and the marking of 1 or 0 contained by the one or more audio signals. When the encoding terminal marks the audio signal of the non-analogous audio signal as 1 or 0, then the decoding terminal obtains a plurality of audio signals from the audio stream and the marking of 1 or 0 contained by one or more audio signals.

In Step 607, the decoding terminal can perform an enhancement-process to one or more audio signals having the designated signal type according to the marking to obtain an enhanced audio signal.

The enhancement-process to one or more audio signals includes a frequency-spectrum enhancement and an acoustic-image extension.

Referring to FIG. 4*b*, the decoded audio signal can be obtained after the audio decoding stream is kernel-stream-decoded. According to the markings, the decoded audio signal can be content-determined whether an enhancement-process needs to be performed to the audio signal.

For example, after the content determination in FIG. 4*b*, the decoding terminal processes the frequency spectrum enhancement to the audio signal marked as 10, and then processes the high frequency recovery and directly processes the high frequency recovery to the audio signal marked as 00 and 01. The audio signal after frequency recovery is again determined whether an acoustic-image extension needs to be processed to the audio signal marked as 00 and 01. According to the markings, the acoustic-image extension can be processed to the audio signal marked as 10. This is followed by a stereo recovery to obtain the audio decoding signal, e.g., to directly process the stereo recovery to the audio signal marked as 00 and 01 to obtain the audio decoding signal.

In addition, when processing the high frequency recovery to the audio signal, the frequency band duplication decoding parameter obtained after the frequency band duplication decoding of the audio decoding stream can be added into the audio signal before the high frequency recovery to realize the high frequency recovery to the audio signal. Further, the stereo decoding parameter obtained after stereo decoding of the audio decoding stream can be added into the audio signal after the high frequency recovery. The audio signal added into the stereo decoding parameter and after the high frequency recovery can be marked again to determine whether the acoustic-image extension needs to be processed to the audio signal according to the markings.

Specifically, an exemplary method for performing a frequency-spectrum enhancement can include exemplary steps as following. In Step 1, a frequency of each audio signal can be obtained. In Step 2, a frequency-spectrum enhancement coefficient of each audio signal can be determined according to the frequency of each audio signal.

For example, for the inputted signal having a frequency of about 60 hz to about 170 hz, the frequency-spectrum enhancement coefficient is defined as:

$$X'(n)=\text{gain_const}*X(n),\ 5\leq n\leq 31,$$

where the gain_const is a gain constant.

For the inputted signal having a frequency of about 2 khz to about 4 khz, the frequency-spectrum enhancement coefficient is defined as:

$$X'(n)=\left(\frac{n-341}{341-170}*(\text{gain_high}-\text{gain_low})+\text{gain_high}\right)*X(n),$$

$$170\leq n\leq 341$$

where the gain_high is a gain upper limit value, and the gain_low is gain lower limit value.

For the inputted signal having a frequency of about 4 khz to about 8 khz, the frequency-spectrum enhancement coefficient is defined as:

$$X'(n)=\left(\frac{n-682}{682-341}*(\text{gain_low}-\text{gain_high})+\text{gain_low}\right)*X(n),$$

$$341<n\leq 682.$$

In Step 3, the frequency-spectrum enhancement can be performed to each audio signal according to the frequency-spectrum enhancement coefficient of each audio signal.

When processing the acoustic-image extension to the analogous audio signal, a time-delaying parameter can be used to process the acoustic-image extension to the analogous audio signal. Specifically, firstly according to the transform form Sk(z) in domain z of the inputted signal X(n), the following formula can be used to obtain related signal dk(z).

$$d_k(z)=G(k,z)*H_k(z)*S_k(z)$$

where 0≤k≤71, and G(k,z) is a function related to an instant determination.

$$H_k(z)=z^{-2}*\varphi(k)*\prod_{m=0}^{2}\frac{Q(k,m)z^{-|d(m)+b|}-a(m)g(k)}{1-a(m)g(k)Q(k,m)z^{-|d(m)+b|}}$$

where $0\leq k\leq 2$, $$Q(k,m)=\exp(-i\pi q(m)f_{center}(k))$$

$$\varphi(k)=\exp(-i\pi q_{\varphi}f_{center}(k))$$

where a(m), q(m), qϕ and fcenter are all constant, and b is constant, e.g., b=1.

In Step 608, the one or more enhanced audio signals can be added into a decoding stream of the plurality of audio signals to obtain an audio decoding signal by the decoding terminal.

The decoding terminal adds the one or more enhanced audio signals into a decoding stream of the plurality of audio signals to obtain an audio decoding signal, and then processes the stereo recovery to the audio decoding signal to obtain recovered stereo around track signal (e.g., having a left and right track signal).

For example, a single track signal Sk(z) and the decorrelation signal of the 'th audio signal after high frequency recovery can have a frequency domain as S[K,i] and D[K,i]. The recovered stereo left and right track signal L[K,i] and R[K,i] are defined as:

$$\begin{bmatrix}L[K,i]\\R[K,i]\end{bmatrix}=H[K,i]\begin{bmatrix}S[K,i]\\D[K,i]\end{bmatrix}$$

where the up-mixing matrix H is defined as:

$$H=\begin{bmatrix}c_l\cos(\alpha+\beta) & c_l\sin(\alpha+\beta)\\ c_r\cos(\beta-\alpha) & c_r\sin(\beta-\alpha)\end{bmatrix}$$

where $$c=10^{HD/20},\ c_l=c*\sqrt{2}\Big/\sqrt{1+c^2},\ c_r=\sqrt{2}\Big/\sqrt{1+c^2},$$

$$\alpha=\arccos(ICC)/2,\ \beta=\alpha\frac{c_r-c_l}{\sqrt{2}}.$$

The exemplary Steps 605-608 can be implemented separately for an audio decoding method at the decoding terminal.

In the disclosed audio enhancing method, the encoding terminal determines whether each audio signal has a designated signal type according to the logarithmic energy, the high zero-crossing rate ratio, and the spectral flux (SF), marks each audio signal as having or not having the designated signal type and then provides a marked audio encoding stream. After obtaining the marked audio encoding stream, the decoding terminal performs an enhancement-process to one or more audio signals marked with the designated signal type to provide an enhanced audio signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain. Further, when processing the frequency spectrum enhancement to the audio signal, the frequency spectrum enhancement coefficient of each audio signal is determined according to the frequency of the audio signal, and the time delaying parameter is used to process the acoustic image extension to the audio signal when processing the acoustic image extension. This can provide improved effect for sensing the audio signal.

Figure 7:
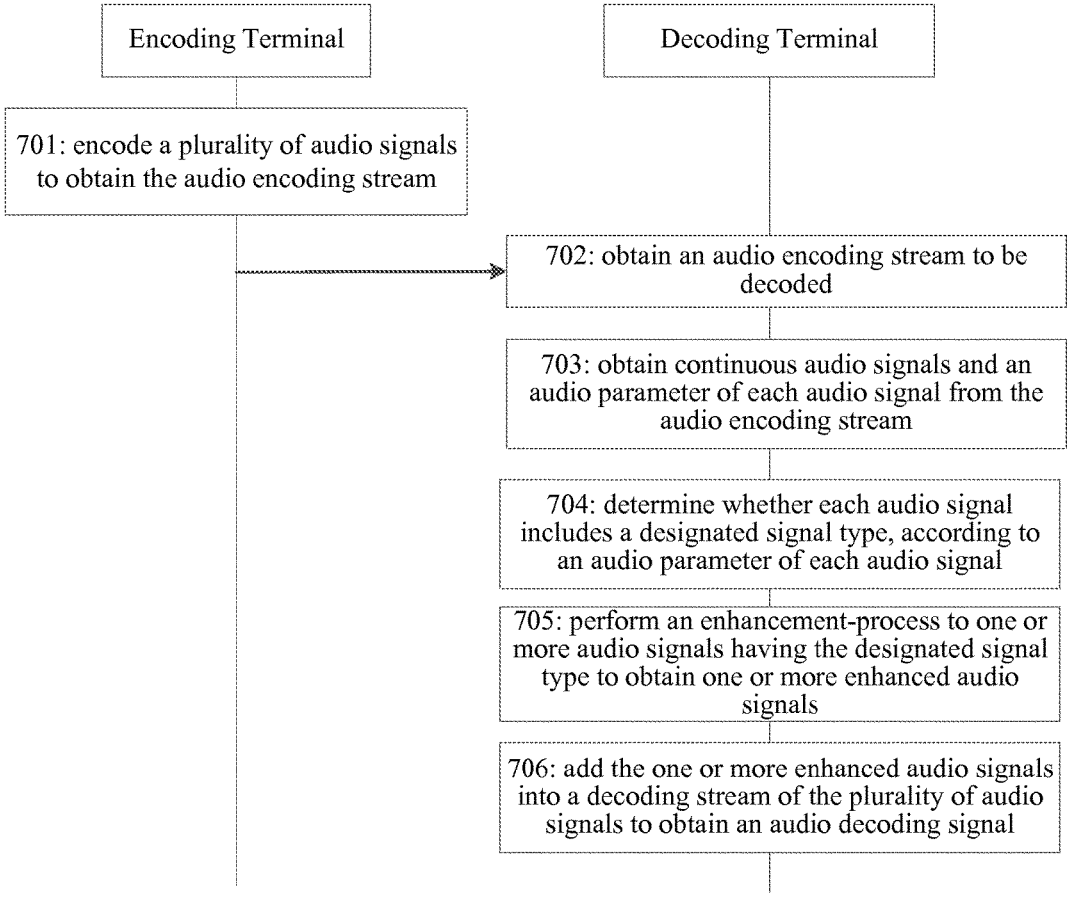
FIG. 7 depicts an exemplary audio enhancement method for FIGS. 5*a*-5*b* consistent with various disclosed embodiments.

FIG. 7 depicts an exemplary audio enhancement method according to an embodiment shown in FIGS. 5*a*-5*b* consistent with various disclosed embodiments. In Step 701, the encoding terminal encodes a plurality of audio signals to obtain the audio encoding stream.

The encoding terminal encodes multiple audio signals according to the logic shown in FIG. 5*a*. A quadrature mirror transform can be processed to multiple audio signals to obtain the audio signal after quadrature-mirror-transform, followed by a down-mix process to obtain the audio signal after down-mix. A 2-time-down-sampling can then be processed to the audio signal after down-mix to obtain the audio signal after 2-time-downsampling. After processing the MDCT transform to the audio signal after 2-time-downsampling, the audio signal can be processed by a quantization encoding to obtain the audio signal after quantization encoding, which can then be added into the encoding stream of the audio signal.

In addition, the audio signal after quadrature-mirror-transform can be processed by a stereo encoding to obtain a stereo encoding parameter of the audio signal. The stereo encoding parameter can be added into the encoding stream of the audio signal. Further, a frequency band duplication encoding can be processed to the audio signal after down-mix to obtain a frequency band duplication encoding parameter, which can also be added into the encoding stream of the audio signal. The final audio encoding stream can thus contain the quantization encoding, the stereo encoding parameter, and the frequency band duplication encoding parameter.

In Step 702, the decoding terminal obtains an audio encoding stream to be decoded. The decoding terminal obtains the audio encoding stream obtained from Step 701. For example, the obtained audio encoding stream can be used as a decoding stream shown in FIG. 5*b*.

In Step 703, the decoding terminal obtains continuous, multiple audio signals and an audio parameter of each audio signal of the continuous, multiple audio signals from the audio encoding stream.

The decoding terminal obtains continuous audio signals and an audio parameter of each audio signal from the audio encoding stream. The audio parameter of each audio signal includes a total frequency-spectrum energy, a spectral flatness measure (SFM), and a spectral flux (SF).

For example, the content determination module of FIG. 5*b* can obtain the frequency-spectrum energy, the spectral flatness measure (SFM), and the spectral flux (SF).

Specifically, the total frequency-spectrum energy of an $^i$th audio signal is defined as:

$$E(i)=\Sigma_{n=(i-1)*L}^{i*L-1}X^2(n)$$

where X(n) is the frequency spectrum coefficient of the inputted signal, L denotes a length of the audio signal (or a frame length of audio signal), e.g., L=960, and n is from 0 to 959.

The spectral flatness measure (SFM) of the $^i$th signal is defined as:

$$SFM(i)=\frac{G_N(i)}{A_n(i)}$$

Where $G_N(i)=\sqrt[N]{X_1*X_2\ldots X_k\ldots X_n}$ {N is the number of Xk, Xk≠0, 1≤k≤n≤L}, denoting geometric average of the $^i$th frame of audio signal (the $^i$th audio signal), and $$A_n(i)=\frac{1}{N}(X_1+X_2+\ldots+X_k+\ldots X_n)$$

{N is the number of Xk, Xk≠0, 1≤k≤n≤L}, denoting count average of the $^i$th frame of audio signal.

The spectral flux is defined as average variance of two adjacent frames of audio signals:

$$SF(i)=\frac{1}{N}\sum_{k=0}^{N-1}[\log(|X(i,k)|+\text{delta})-\log(|X(i-1,k)|+\text{delta})]^2$$

where, X(i, k) is the frequency spectrum coefficient of the $^i$th signal, k is the subscript of the frequency spectrum coefficient 0≤k≤959, and delta is a relatively low number, e.g. delta=0.0001.

In Step 704, the decoding terminal determines whether each audio signal includes a designated signal type according to an audio parameter of each audio signal.

The designated signal type can be an analogous audio signal. The decoding terminal determines whether each audio signal is an analogous audio signal according to an audio parameter of each audio signal.

The decoding terminal determines that an audio signal is the analogous audio signal, when the total frequency-spectrum energy of the audio signal is more than a fourth threshold value, the spectral flatness measure (SFM) is less than a fifth threshold value, and the spectral flux (SF) is more than a third threshold value.

For example, the $^i$th audio signal can be determined to be the analogous audio signal, when the total frequency-spectrum energy of the $^i$th frequency spectrum signal is more than 105, the spectral flatness measure (SFM) of the $^i$th signal is less than 0.8, the spectral flux of the $^i$th audio signal (that is the average variance of the $^i$th frame signal and the i−1th frame signal) is more than 20.

An exemplary process can be used to determine an audio signal as following. Firstly, it is determined whether the total frequency-spectrum energy of the audio signal is more than the fourth threshold value, e.g., the fourth threshold value can be 105. When the total frequency-spectrum energy of the audio signal is not more than the fourth threshold value, the audio signal is determined not to be the analogous audio signal. When the total frequency-spectrum energy of the audio signal is more than the fourth threshold value, it is then determined whether the spectral flatness measure (SFM) of the audio signal is less than the fifth threshold value, and the fifth threshold value can be about 0.8.

When the spectral flatness measure (SFM) of the audio signal is not less than the fifth threshold value, the audio signal is determined not to be the analogous audio signal. When the spectral flatness measure (SFM) of the audio signal is less than the fifth threshold value, it is then determined whether the spectral flux of the audio signal is more than the third threshold value, and the third threshold value can be about 20.

When the spectral flux of the audio signal is more than the third threshold value, the audio signal is determined to be the analogous audio signal. When the spectral flux of the audio signal is not more than the third threshold value, the audio signal is determined not to be the analogous audio signal.

It is noted that, the decoding terminal can also process the marking to the audio signal according to the determined results to distinguish the analogous audio signal and the non-analogous audio signal, such that when subsequently determining whether an enhancement-process needs to be processed to the audio signal, the marking of the audio signal can be directly used to determine whether the enhancement-process is needed.

Specifically, when the decoding terminal marks the audio signal, a first marking is performed to the audio signal(s) of the analogous audio signal. No marking can be performed to the audio signal(s) of non-analogous audio signal. Alternatively, a first marking is performed to the audio signal(s) of the analogous audio signal, while other markings can be performed to non-analogous audio signal(s). Still alternatively, no marking is performed to the audio signal(s) of the analogous audio signal, while other markings can be performed to the audio signal(s) of non-analogous audio signal.

For example, when using one bit to mark the audio signal, the encoding terminal can mark the audio signal(s) of the analogous audio signal as 1 or 0, without marking the audio signal(s) of the non-analogous audio signal. Or, the encoding terminal can mark the audio signal(s) of the analogous audio signal as 1 and mark the audio signal of the non-analogous audio signal as 0. Or, the encoding terminal may not mark the audio signal(s) of the analogous audio signal and mark the audio signal(s) of the non-analogous audio signal as 1 or 0.

In one embodiment, the audio signals may not be marked and it is then directly determined whether an enhancement process can be performed based on a determination content, e.g. as shown in FIG. 5*b*. For example, Steps 703-704 of FIG. 7 can be contained in the content determination module of FIG. 5*b*.

In Step 705, the decoding terminal performs an enhancement-process to one or more audio signals having the designated signal type to obtain one or more enhanced audio signals. The enhancement-process to the audio signal includes a frequency-spectrum enhancement and an acoustic-image extension.

Referring to FIG. 5*b*, the decoded audio signal is obtained after the audio decoding stream is kernel-stream-decoded. According to the markings, the decoded audio signal is determined whether the enhancement-process needs to be processed to the audio signal.

For example, after the content determination in FIG. 5*b*, the decoding terminal processes a frequency spectrum enhancement to the analogous audio signal, and then processes the high frequency recovery, while directly processes the high frequency recovery to the audio signal of the non-analogous audio signal. The frequency-recovered audio signal can then be further determined whether an acoustic-image extension needs to be processed. The audio signal of the analogous audio signal can be processed by the acoustic-image extension and then by a stereo recovery. The audio signal of the non-analogous audio signal can be processed directly by the stereo recovery without the acoustic-image extension, to provide the audio decoding signal.

In addition, when processing the high frequency recovery to the audio signal, the frequency band duplication decoding parameter obtained after the frequency band duplication decoding of the audio decoding stream can be added into the audio signal before the high frequency recovery to realize the high frequency recovery to the audio signal. Further, the stereo decoding parameter obtained after stereo decoding of the audio decoding stream can be added into the audio signal after the high frequency recovery. The audio signal added into the stereo decoding parameter and after the high frequency recovery can be marked again to determine whether the acoustic-image extension needs to be processed to the audio signal according to the markings.

Specifically, an exemplary method for performing a frequency-spectrum enhancement can include exemplary steps as following.

In Step 1, a frequency of each audio signal can be obtained. In Step 2, a frequency-spectrum enhancement coefficient of each audio signal can be determined according to the frequency of each audio signal.

For example, for the inputted signal having a frequency of about 60 hz to about 170 hz, the frequency-spectrum enhancement coefficient is defined as:

$$X'(n)=\text{gain_const}*X(n),\ 5\leq n\leq 31$$

where the gain_const is a gain constant.

For the inputted signal having a frequency of about 2 khz to about 4 khz, the frequency-spectrum enhancement coefficient is defined as:

$$X'(n)=\left(\frac{n-341}{341-170}*(\text{gain_high}-\text{gain_low})+\text{gain_high}\right)*X(n),$$

$$170\leq n\leq 341$$

where the gain_high is a gain upper limit value, and the gain_low is gain lower limit value. For the inputted signal having a frequency of about 4 khz to about 8 khz, the frequency-spectrum enhancement coefficient is defined as:

$$X'(n)=\left(\frac{n-682}{682-341}*(\text{gain_low}-\text{gain_high})+\text{gain_low}\right)*X(n),$$

$$341<n\leq 682.$$

In Step 3, the frequency-spectrum enhancement can be performed to each audio signal according to the frequency-spectrum enhancement coefficient of each audio signal.

When processing the acoustic-image extension to the analogous audio signal, a time-delaying parameter can be used to process the acoustic-image extension to the analogous audio signal. Specifically, firstly according to the transform form Sk(z) in domain z of the inputted signal X(n), the following formula can be used to obtain related signal dk(z):

$$d_k(z)=G(k,z)*H_k(z)*S_k(z)$$

where 0≤k≤71, and G(k,z) is a function related to an instant determination.

$$H_k(z)=z^{-2}*\varphi(k)*\prod_{m=0}^{2}\frac{Q(k,m)z^{-|d(m)+b|}-a(m)g(k)}{1-a(m)g(k)Q(k,m)z^{-|d(m)+b|}}$$

$$\text{Where } 0\leq k\leq 2,$$

$$Q(k,m)=\exp(-i\pi q(m)f_{center}(k))$$

$$\varphi(k)=\exp(-i\pi q_{\varphi}f_{center}(k))$$

where a(m), q(m), $q_{\varphi}$ and $f_{center}$ are all constant, and b is constant, e.g., b=1.

In Step 706, the decoding terminal adds the one or more enhanced audio signals into a decoding stream of the multiple audio signals to obtain an audio decoding signal.

The decoding terminal adds the one or more enhanced audio signals into a decoding stream of the plurality of audio signals to obtain an audio decoding signal, and then processes the stereo recovery to the audio decoding signal to obtain recovered stereo around track signal (e.g., having a left and right track signal).

For example, the single track signal Sk(z) and the decorrelation signal of after the $^{i}$th audio signal is high frequency recovered, individually is S[K, i] and D[K, i], then the post-recovered stereo left and right track signal L[K, i] and R[K, i] are defined as:

$$\begin{bmatrix} L[K, i] \\ R[K, i] \end{bmatrix} = H[K, i] \begin{bmatrix} S[K, i] \\ D[K, i] \end{bmatrix}$$

where the up-mixing matrix H is defined as:

$$H = \begin{bmatrix} c_l\cos(\alpha+\beta) & c_l\sin(\alpha+\beta) \\ c_r\cos(\beta-\alpha) & c_r\sin(\beta-\alpha) \end{bmatrix} \text{ where}$$

$$c = 10^{HD/20},\ c_l = c * \sqrt{2} \Big/ \sqrt{1+c^2},\ c_r = \sqrt{2} \Big/ \sqrt{1+c^2},$$

$$\alpha = \arccos(ICC)/2, \text{ and } \beta = \alpha\frac{c_r - c_l}{\sqrt{2}}.$$

The exemplary Steps 702-706 can be implemented separately for an audio decoding method at the decoding terminal.

In the disclosed audio enhancing method, the decoding terminal determines whether each audio signal is a designated audio signal type, according to the total frequency-spectrum energy, the spectral flatness measure (SFM), and the spectral flux (SF), performs the enhancement-process to one or more audio signals having the designated signal type to provide an enhanced audio signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process.

In addition, computation complexity can be decreased as compared with conventional enhancement methods by converting from a time domain into a frequency domain. Further, when processing the frequency spectrum enhancement to the audio signal, the frequency spectrum enhancement coefficient of each audio signal is determined according to the frequency of the audio signal, and the time delaying parameter is used to process the acoustic image extension to the audio signal when processing the acoustic image extension. This can provide improved effect for sensing the audio signal.

Figure 8:
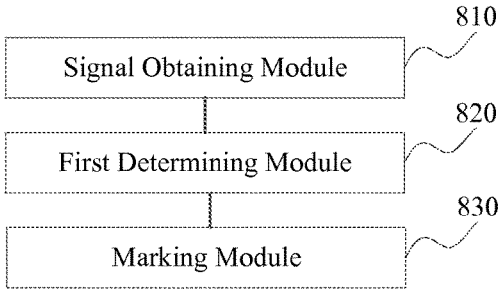
FIG. 8 depicts an exemplary audio encoding apparatus consistent with various disclosed embodiments.

FIG. 8 depicts an exemplary audio encoding apparatus consistent with various disclosed embodiments. In some embodiments, the disclosed audio encoding apparatus can be a part of an encoding terminal. In other embodiment, the disclosed audio encoding apparatus can be an encoding terminal. The disclosed audio encoding apparatus can include a software product, a hardware component, and a combination thereof.

The exemplary audio encoding apparatus includes: a signal obtaining module 810, a first determining module 820, and/or a marking module 830. The signal obtaining module 810 is configured to obtain a plurality of audio signals that are continuous.

The first determining module 820 is configured to determine whether each audio signal obtained by the signal obtaining module 810 includes a designated signal type, according to an audio parameter of each audio signal. The marking module 830 is configured to perform a marking to each audio signal as having or not having the designated signal type determined by the first determining module 820 to obtain a marked audio encoding stream.

The marking is used at a decoding terminal to perform an enhancement-process to one or more audio signals having the designated signal type.

In the disclosed audio encoding apparatus, the audio parameter of each audio signal can be used to determine whether each audio signal includes the designated signal type, and each audio signal can thus be marked as having or not having the designated signal type to provide a marked audio encoding stream. The marking is used for the decoding terminal to perform an enhancement-process to one or more audio signals having the designated signal type. When an audio signal undergoes an enhancement-process, quantization noises (introduced by codec) can be increased. This can adversely affect the degree of being sensed of the audio signals.

The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain.

Figure 9:
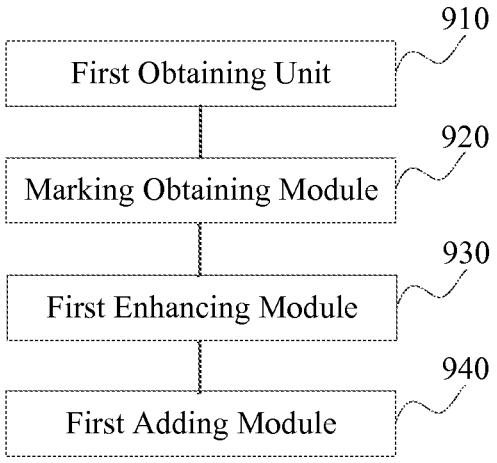
FIG. 9 depicts an exemplary audio decoding apparatus consistent with various disclosed embodiments.

FIG. 9 depicts an exemplary audio decoding apparatus consistent with various disclosed embodiments. In some embodiments, the disclosed audio decoding apparatus can be a part of a decoding terminal. In other embodiment, the disclosed audio decoding apparatus can be a decoding terminal. The disclosed audio decoding apparatus can include a software product, a hardware component, and a combination thereof.

The exemplary audio decoding apparatus includes a first obtaining unit 910, a marking obtaining module 920, a first enhancing module 930, and/or a first adding module 940.

The first obtaining unit 910 is configured to obtain an audio encoding stream after a marking that is performed to each audio signal of a plurality of audio signals as having or not having a designated signal type.

The marking obtaining module 920 is configured to obtain the plurality of audio signals from the audio encoding stream obtained by the first obtaining module 910 and to obtain the marking of at least a portion of the plurality of audio signals.

The first enhancing module 930 is configured to perform an enhancement-process to one or more audio signals having the designated signal type according to the marking obtained by the marking obtaining module 920 to obtain an enhanced audio signal.

The first adding module 940 is configured to add the enhanced audio signal from the first enhancing module 930 into a decoding stream of the plurality of audio signals to obtain an audio decoding signal.

In the disclosed audio decoding apparatus, by obtaining a plurality of audio signals and marking of a portion or all of the plurality of audio signals from the marked audio encoding stream, an enhancement-process can be performed to one or more audio signals having the designated signal type according to the marking. An enhanced audio signal can then be obtained and added into a decoding stream of the plurality of audio signals to obtain an audio decoding signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain.

Figure 10:
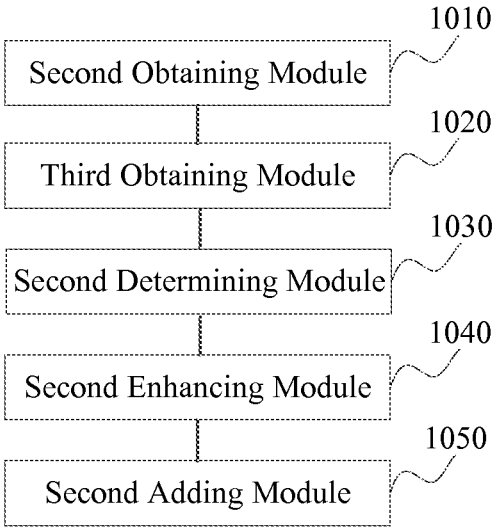
FIG. 10 depicts another exemplary audio decoding apparatus consistent with various disclosed embodiments.

FIG. 10 depicts another exemplary audio decoding apparatus consistent with various disclosed embodiments. In some embodiments, the disclosed audio decoding apparatus can be a part of a decoding terminal. In other embodiment, the disclosed audio decoding apparatus can be a decoding terminal. The disclosed audio decoding apparatus can include a software product, a hardware component, and a combination thereof.

The exemplary audio decoding apparatus includes: a second obtaining module 1010, a third obtaining module 1020, a second determining module 1030, a second enhancing module 1040, and/or a second adding module 1050.

The second obtaining module 1010 is configured to obtain an audio encoding stream to be decoded. The third obtaining module 1020 is configured to obtain, a plurality of audio signals that are continuous and an audio parameter of each audio signal, from the audio encoding stream obtained by the second obtaining module 1010.

The second determining module 1030 is configured to determine whether each audio signal includes a designated signal type, according to the audio parameter of each audio signal obtained by the third obtaining module 1020.

The second enhancing module 1040 is configured to perform an enhancement-process to one or more audio signals having the designated signal type determined by the second determining module 1030 to obtain one or more enhanced audio signals.

The second adding module 1050 is configured to add the one or more enhanced audio signals enhanced by the second enhancing module 1040 into a decoding stream of the plurality of audio signals to obtain an audio decoding signal.

In the disclosed audio decoding apparatus, continuous multiple audio signals and an audio parameter of each audio signal can be obtained from the audio encoding stream. It is then determined whether each audio signal includes a designated signal type according to an audio parameter of each audio signal. An enhancement-process can be performed to one or more audio signals having the designated signal type to obtain one or more enhanced audio signals. The one or more enhanced audio signals can be added into a decoding stream of the multiple audio signals to obtain an audio decoding signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain.

Figure 11:
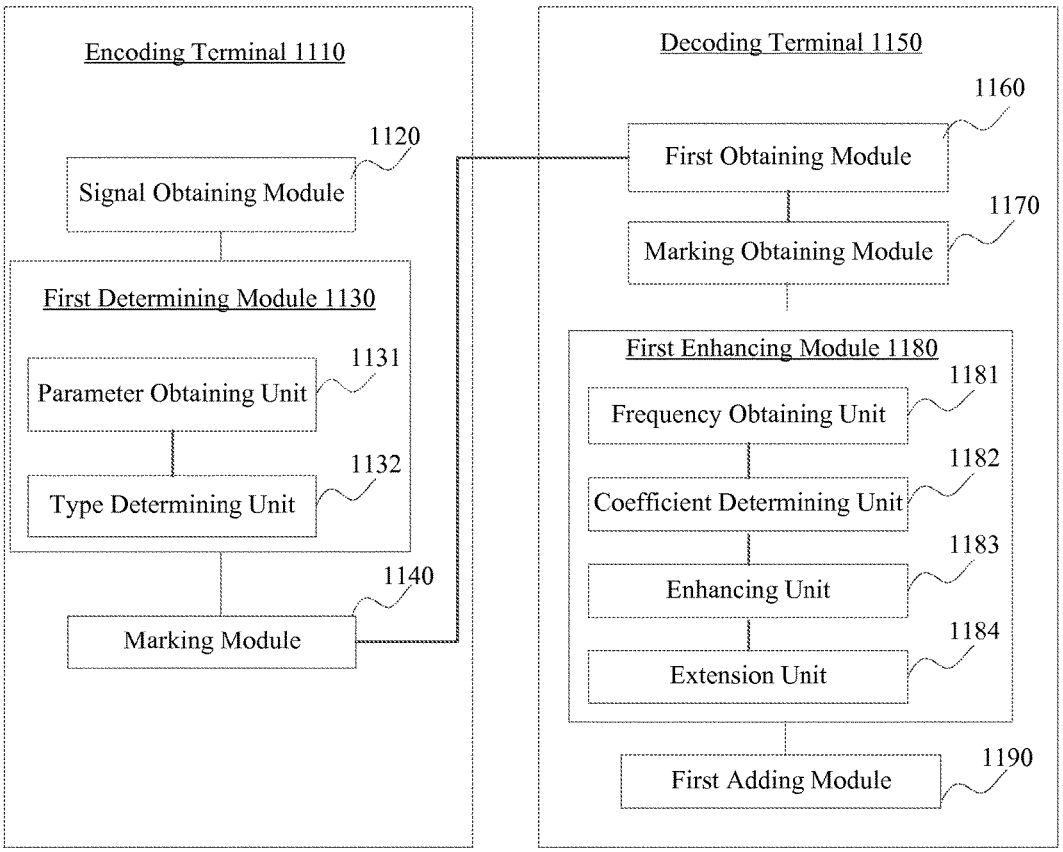
FIG. 11 depicts an exemplary audio codec system consistent with various disclosed embodiments.

FIG. 11 depicts an exemplary audio codec system consistent with various disclosed embodiments. The audio codec system includes an encoding terminal 1110 and a decoding terminal 1150.

The encoding terminal 1110 includes: a signal obtaining module 1120, a first determining module 1130, and/or a marking module 1140. The signal obtaining module 1120 is configured to obtain a plurality of audio signals that are continuous.

The first determining module 1130 is configured to determine whether each audio signal obtained by the signal obtaining module 1120 includes a designated signal type, according to an audio parameter of each audio signal.

The designated signal type is an analogous audio signal, and the first determining module 1130 includes: a parameter obtaining unit 1131 and/or a type determining unit 1132.

The parameter obtaining unit 1131 is configured to obtain the audio parameter of each audio signal. The audio parameter includes logarithmic energy, a high-zero-crossing-rate-ratio (HZCRR), and a spectral flux (SF).

The type determining unit 1132 is configured to determine whether each audio signal is the analogous audio signal according to the logarithmic energy, the high zero-crossing rate ratio, and the spectral flux (SF) obtained by the parameter obtaining unit 1131.

The type determining unit 1132 is configured to determine that an audio signal is the analogous audio signal, when the logarithmic energy of the audio signal is no less than a first threshold value, the HZCRR is no more than a second threshold value, and the spectral flux is more than a third threshold value.

The marking module 1140 is configured to perform a marking to each audio signal as having or not having the designated signal type determined by the first determining module 1130 to obtain a marked audio encoding stream. The marking is used at the decoding terminal to perform an enhancement-process to one or more audio signals having the designated signal type.

The marking module 1140 includes: a making unit 1141 and/or an adding unit 1142. The making unit 1141 is configured to perform a marking to each audio signal as having or not having the designated signal type.

The adding unit 1142 is configured to add the marking into the encoding stream of the audio signal, to obtain the audio encoding stream of having the marking. The adding unit 1142 includes: a quadrature sub-unit 1142*a*, a down-mixed sub-unit 1142*b*, a sampling sub-unit 1142*c*, an encoding sub-unit 1142*d*, a stereo sub-unit 1142*e*, and/or a frequency band sub-unit 1142*f*.

The quadrature sub-unit 1142*a* is configured to use the audio signal as the inputted signal to process the quadrature mirror transform and to obtain the audio signal after quadrature-mirror-transform. The down-mixed sub-unit 1142*b* is configured to process a down-mix to the audio signal after quadrature-mirror-transform and to obtain the audio signal after down-mix.

The sampling sub-unit 1142*c* is configured to process 2-time-downsampling to the audio signal after down-mix and to obtain the audio signal after 2-time-downsampling. The encoding sub-unit 1142*d* is configured to process a kernel encoding to the audio signal after 2-time-downsampling to obtain the quantization encoded signal of the audio signal.

The stereo sub-unit 1142*e* is configured to process a stereo encoding to the audio signal after quadrature-mirror-transform and to obtain a stereo encoding parameter, which can be added into the encoding stream of the audio signal. The frequency band sub-unit 1142*f* is configured to process the frequency band duplication encoding to the down-mixed audio signal and to obtain the frequency band duplication encoding parameter, which can then be added to the encoding stream of the audio signal.

The encoding terminal 1150 includes: a first obtaining module 1160, a marking obtaining module 1170, a first enhancing module 1180, and/or a first adding module 1190.

The first obtaining module 1160 is configured to obtain an audio encoding stream after a marking that is performed to each audio signal of a plurality of audio signals as having or not having a designated signal type.

The marking obtaining module 1170 is configured to obtain the plurality of audio signals from the audio encoding stream obtained by the first obtaining module 1160 and to obtain the marking of at least a portion of the plurality of audio signals.

The first enhancing module 1180 is configured to perform an enhancement-process to one or more audio signals having the designated signal type according to the marking obtained by the marking obtaining module 1170, to obtain an enhanced audio signal.

The designated signal type is an analogous audio signal, and the first enhancing module 1180 is configured to perform a frequency-spectrum enhancement and an acoustic-image extension to the analogous audio signal.

Specifically, the first enhancing module 1180 includes: a frequency obtaining unit 1181, a coefficient determining unit 1182, and/or an enhancing unit 1183.

The frequency obtaining unit 1181 is configured to obtain a frequency of each audio signal. The coefficient determining unit 1182 is configured to determine a frequency-spectrum enhancement coefficient of each audio signal, according to the frequency of each audio signal obtained by the frequency obtaining unit 1181.

The enhancing unit 1183 is configured to perform the frequency-spectrum enhancement to each audio signal, according to the frequency-spectrum enhancement coefficient of each audio signal determined by the coefficient determining unit 1182.

The first enhancing module 1180 further includes an extension unit 1184. The extension unit 1184 is configured to use a time delaying parameter to perform the acoustic-image extension to the analogous audio signal.

The first adding module 1190 is configured to add the enhanced audio signal by the first enhancing module 1180 into a decoding stream of the plurality of audio signals to obtain an audio decoding signal.

In the disclosed audio enhancing system, the encoding terminal determines whether each audio signal has a designated signal type according to the logarithmic energy, the high zero-crossing rate ratio, and the spectral flux (SF), marks each audio signal as having or not having the designated signal type and then provides a marked audio encoding stream. After obtaining the marked audio encoding stream, the decoding terminal performs an enhancement-process to one or more audio signals marked with the designated signal type to provide an enhanced audio signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process.

In addition, computation complexity can be decreased as compared with conventional enhancement methods by converting from a time domain into a frequency domain. Further, when processing the frequency spectrum enhancement to the audio signal, the frequency spectrum enhancement coefficient of each audio signal is determined according to the frequency of the audio signal, and the time delaying parameter is used to process the acoustic image extension to the audio signal when processing the acoustic image extension. This can provide improved effect for sensing the audio signal.

Figure 12:
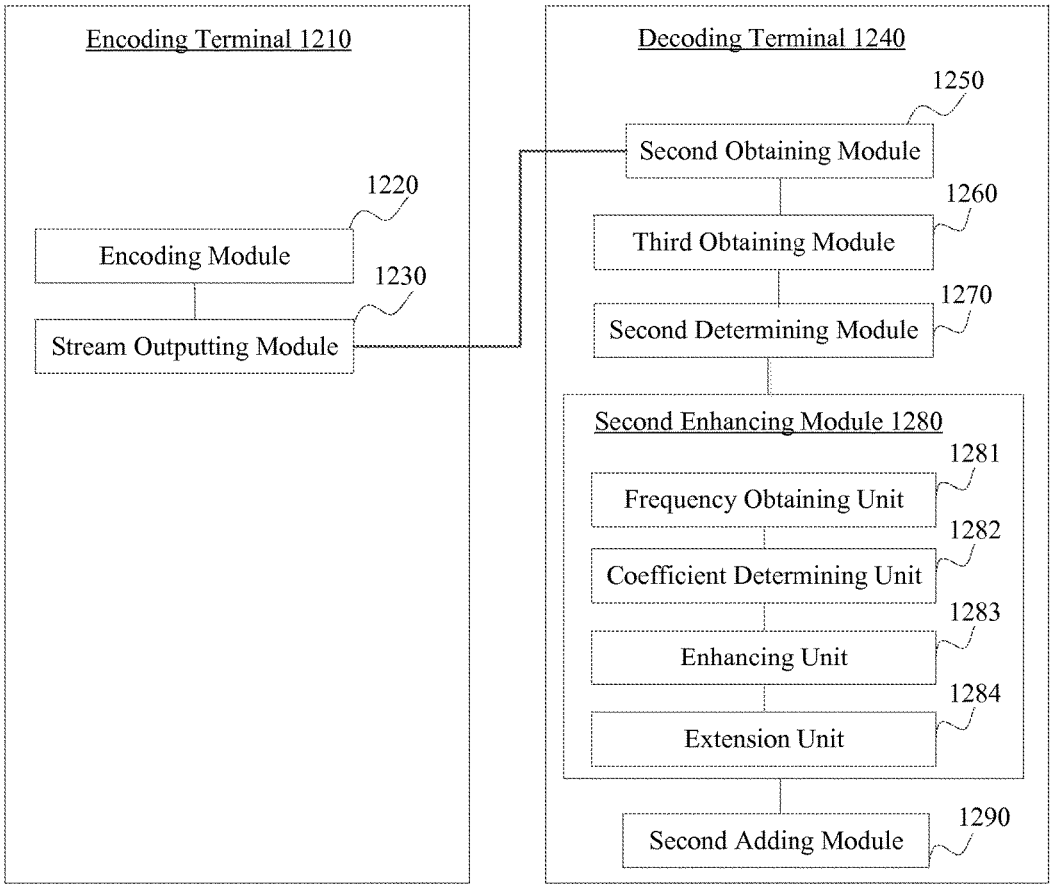
FIG. 12 depicts another exemplary audio codec system consistent with various disclosed embodiments.

FIG. 12 depicts another exemplary audio codec system consistent with various disclosed embodiments. The audio codec system includes an encoding terminal 1210 and a decoding terminal 1240.

The encoding terminal 1210 includes: an encoding module 1220 and/or a stream outputting module 1230. The encoding module 1220 is configured to encode a plurality of audio signals according to the encoding algorithm of FIG. 5*a*.

The stream outputting module 1230 is configured to output the obtained encoding stream encoded by the encoding module 1220 to the decoding terminal. The decoding terminal 1240 includes: a second obtaining module 1250, a third obtaining module 1260, a second determining module 1270, and/or a second enhancing module 1280.

The second obtaining module 1250 is configured to obtain an audio encoding stream to be decoded. The third obtaining module 1260 is configured to obtain, a plurality of audio signals that are continuous and an audio parameter of each audio signal, from the audio encoding stream obtained by the second obtaining module 1250.

The second determining module 1270 is configured to determine whether each audio signal includes a designated signal type, according to the audio parameter of each audio signal obtained by the third obtaining module 1260.

The designated signal type is an analogous audio signal. The audio parameter of each audio signal includes total frequency-spectrum energy, a spectral flatness measure (SFM), and a spectral flux (SF). The second determining module 1270 is configured to determine that an audio signal is the analogous audio signal, when the total frequency-spectrum energy of the audio signal is more than a fourth threshold value, the spectral flatness measure (SFM) is less than a fifth threshold value, and the spectral flux(SF) is more than a third threshold value.

The second enhancing module 1280 is configured to perform an enhancement-process to one or more audio signals having the designated signal type determined by the second determining module 1270 to obtain one or more enhanced audio signals.

The second adding module 1290 is configured to perform a frequency-spectrum enhancement and an acoustic-image extension to the analogous audio signal.

Specifically, the second enhancing module 1280 includes: a frequency obtaining unit 1281, a coefficient determining unit 1282, and/or an enhancing unit 1283. The frequency obtaining unit 1281 is configured to obtain a frequency of each audio signal.

The coefficient determining unit 1282 is configured to determine a frequency-spectrum enhancement coefficient of each audio signal, according to the frequency of each audio signal obtained by the frequency obtaining unit 1281.

The enhancing unit 1283 is configured to perform the frequency-spectrum enhancement to each audio signal, according to the frequency-spectrum enhancement coefficient of each audio signal determined by the coefficient determining unit 1282.

The second enhancing module 1280 further includes: an extension unit 1284. The extension unit 1284 is configured to use a time delaying parameter to perform the acoustic-image extension to the analogous audio signal.

The second adding module 1290 is configured to add the one or more enhanced audio signals enhanced by the second enhancing module 1280 into a decoding stream of the plurality of audio signals to obtain an audio decoding signal.

In the disclosed audio enhancing system, the decoding terminal determines whether each audio signal is a designated audio signal type, according to the total frequency-spectrum energy, the spectral flatness measure (SFM), and the spectral flux (SF), performs the enhancement-process to one or more audio signals having the designated signal type to provide an enhanced audio signal. When an audio signal undergoes an enhancement-process, quantization noises (introduced by codec) can be increased. This can adversely affect the degree of being sensed of the audio signals.

The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain. Further, when processing the frequency spectrum enhancement to the audio signal, the frequency spectrum enhancement coefficient of each audio signal is determined according to the frequency of the audio signal, and the time delaying parameter is used to process the acoustic image extension to the audio signal when processing the acoustic image extension. This can provide improved effect for sensing the audio signal.

Figure 13:
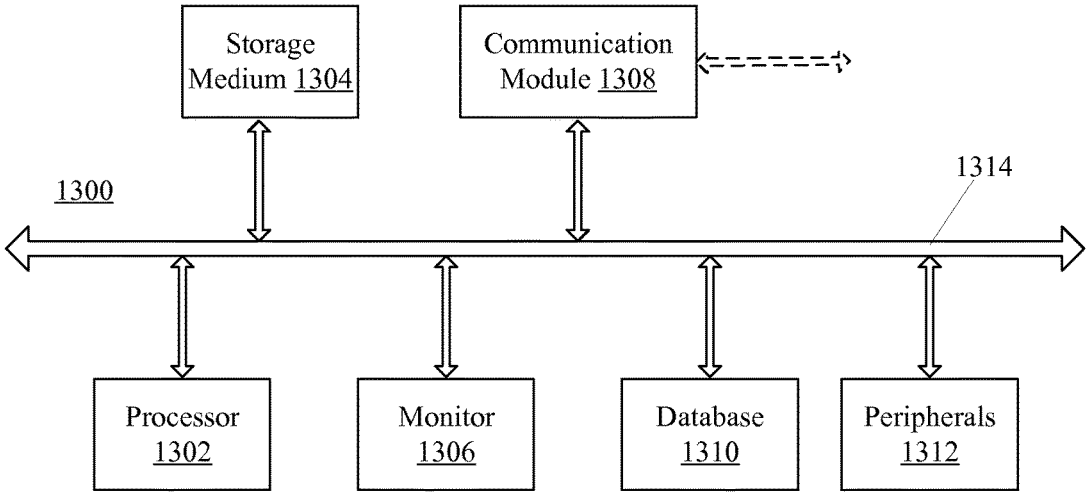
FIG. 13 depicts an exemplary computer system consistent with the disclosed embodiments.

FIG. 13 shows a block diagram of an exemplary computer system 1300 capable of implementing the disclosed methods. For example, the disclosed encoding terminal and decoding terminal can include the exemplary computer system 1300.

As shown in FIG. 13, the exemplary computer system 1300 may include a processor 1302, a storage medium 1304, a monitor 1306, a communication module 1308, a database 1310, peripherals 1312, and one or more bus 1314 to couple the devices together. Certain devices may be omitted and other devices may be included.

Processor 1302 can include any appropriate processor or processors. Further, processor 1302 can include multiple cores for multi-thread or parallel processing. Storage medium (e.g., a non-transitory computer-readable storage medium) 1304 may include memory modules, such as ROM, RAM, and flash memory modules, and mass storages, such as CD-ROM, U-disk, removable hard disk, etc. Storage medium 1304 may store computer programs for implementing various processes, when executed by processor 1302.

Further, peripherals 1312 may include I/O devices such as keyboard and mouse, and communication module 1308 may include network devices for establishing connections through the communication network. Database 1310 may include one or more databases for storing certain data and for performing certain operations on the stored data, such as webpage browsing, database searching, etc. audio encoding methods, audio decoding methods, encoding terminals, decoding terminals, and audio codec systems For example, the disclosed audio encoding methods and/or audio decoding methods can be implemented by encoding (and/or decoding) terminals, as shown in FIG. 13, that include one or more processor, and a non-transitory computer-readable storage medium having instructions stored thereon. The instructions can be executed by the one or more processors of the apparatus/device to perform the methods disclosed herein. In some cases, the instructions can include one or more modules corresponding to the disclosed methods and terminals.

It should be understood that steps described in various methods of the present disclosure may be carried out in order as shown, or alternately, in a different order. Therefore, the order of the steps illustrated should not be construed as limiting the scope of the present disclosure. In addition, certain steps may be performed simultaneously.

In the present disclosure each embodiment is progressively described, i.e., each embodiment is described and focused on difference between embodiments. Similar and/or the same portions between various embodiments can be referred to with each other. In addition, exemplary apparatus and/or systems are described with respect to corresponding methods.

The disclosed methods, apparatus, and/or systems can be implemented in a suitable computing environment. The disclosure can be described with reference to symbol(s) and step(s) performed by one or more computers, unless otherwise specified. Therefore, steps and/or implementations described herein can be described for one or more times and executed by computer(s). As used herein, the term "executed by computer(s)" includes an execution of a computer processing unit on electronic signals of data in a structured type. Such execution can convert data or maintain the data in a position in a memory system (or storage device) of the computer, which can be reconfigured to alter the execution of the computer as appreciated by those skilled in the art. The data structure maintained by the data includes a physical location in the memory, which has specific properties defined by the data format. However, the embodiments described herein are not limited. The steps and implementations described herein may be performed by hardware.

As used herein, the term "module" or "unit" can be software objects executed on a computing system. A variety of components described herein including elements, modules, units, engines, and services can be executed in the computing system. The methods, apparatus, and/or systems can be implemented in a software manner. Of course, the methods, apparatus, and/or systems can be implemented using hardware. All of which are within the scope of the present disclosure.

A person of ordinary skill in the art can understand that the units/modules included herein are described according to their functional logic, but are not limited to the above descriptions as long as the units/modules can implement corresponding functions. Further, the specific name of each functional module is used to be distinguished from one another without limiting the protection scope of the present disclosure.

In various embodiments, the disclosed units/modules can be configured in one apparatus (e.g., a processing unit) or configured in multiple apparatus as desired. The units/modules disclosed herein can be integrated in one unit/module or in multiple units/modules. Each of the units/modules disclosed herein can be divided into one or more sub-units/modules, which can be recombined in any manner. In addition, the units/modules can be directly or indirectly coupled or otherwise communicated with each other, e.g., by suitable interfaces.

One of ordinary skill in the art would appreciate that suitable software and/or hardware (e.g., a universal hardware platform) may be included and used in the disclosed methods, apparatus, and/or systems. For example, the disclosed embodiments can be implemented by hardware only, which alternatively can be implemented by software products only. The software products can be stored in computer-readable storage medium including, e.g., ROM/RAM, magnetic disk, optical disk, etc. The software products can include suitable commands to enable a terminal device (e.g., including a mobile phone, a personal computer, a server, or a network device, etc.) to implement the disclosed embodiments.

For example, the disclosed methods can be implemented by an apparatus/device including one or more processor, and a non-transitory computer-readable storage medium having instructions stored thereon. The instructions can be executed by the one or more processors of the apparatus/device to perform the methods disclosed herein. In some cases, the instructions can include one or more modules corresponding to the disclosed methods.

Note that, the term "comprising", "including" or any other variants thereof are intended to cover a non-exclusive inclusion, such that the process, method, article, or apparatus containing a number of elements also include not only those elements, but also other elements that are not expressly listed; or further include inherent elements of the process, method, article or apparatus. Without further restrictions, the statement "includes a . . . " does not exclude other elements included in the process, method, article, or apparatus having those elements.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

Audio encoding methods/terminals, audio decoding methods/terminals, and audio codec systems are provided. A plurality of audio signals that are continuous is obtained. It is determined whether each audio signal of the plurality of audio signals includes a designated signal type, according to an audio parameter of each audio signal. A marked audio encoding stream is obtained by performing a marking to each audio signal as having or not having the designated signal type. The marking is used, at a decoding terminal, to perform an enhancement-process to one or more audio signals having the designated signal type. The enhancement-process is not performed to audio signals that do not have the designated signal type.

In the disclosed audio enhancing method, the encoding terminal determines whether each audio signal has a designated signal type according to the logarithmic energy, the high zero-crossing rate ratio, and the spectral flux (SF), marks each audio signal as having or not having the designated signal type and then provides a marked audio encoding stream. After obtaining the marked audio encoding stream, the decoding terminal performs an enhancement-process to one or more audio signals marked with the designated signal type to provide an enhanced audio signal.

When an audio signal undergoes an enhancement-process, quantization noises (introduced by codec) can be increased. This can adversely affect the degree of being sensed of the audio signals. The disclosed methods can perform an enhancement-process only to audio signal(s) having a designated signal type, while do not perform the enhancement-process to the audio signal(s) not having the designated signal type. The audio signals can thus have desired degree of being sensed during the enhancement-process. In addition, computation complexity can be decreased as compared with conventional enhancement methods by converting from a time domain into a frequency domain. Further, when processing the frequency spectrum enhancement to the audio signal, the frequency spectrum enhancement coefficient of each audio signal is determined according to the frequency of the audio signal, and the time delaying parameter is used to process the acoustic image extension to the audio signal when processing the acoustic image extension. This can provide improved effect for sensing the audio signal.

What is claimed is:

1. An audio encoding method, comprising:

obtaining a plurality of audio signals that are continuous;

determining a type of each audio signal of the plurality of audio signals, according to an audio parameter of each audio signal, wherein the type of each audio signal is one of a designated signal type, a voice signal type, and a mute signal type; and obtaining a marked audio encoding stream by performing a marking to each audio signal as having or not having the designated signal type, wherein the marking is used at a decoding terminal to perform an enhancement-process to one or more audio signals having the designated signal type, wherein the enhancement-process is not performed to audio signals that do not have the designated signal type, wherein the designated signal type is an analogous audio signal, and the step of determining the type of each audio signal comprises:

obtaining the audio parameter of each audio signal, wherein the audio parameter comprises logarithmic energy, a high-zero-crossing-rate-ratio (HZCRR), and a spectral flux (SF);

determining that an audio signal is the mute signal type, when the logarithmic energy of the audio signal is less than a first threshold value;

determining that an audio signal is the voice signal type, when the logarithmic energy of the audio signal is no less than the first threshold value, and the HZCRR is more than a second threshold value; and determining that an audio signal is the designated signal type, when the logarithmic energy of the audio signal is no less than the first threshold value, the HZCRR is no more than the second threshold value, and the spectral flux is more than a third threshold value.

2. The method according to claim 1, wherein the designated signal type is an analogous audio signal.

3. The method according to claim 1, further comprising:

obtaining the marked audio encoding stream;

obtaining the plurality of audio signals from the marked audio encoding stream and obtaining the marking of at least a portion of the plurality of audio signals;

performing the enhancement-process to one or more audio signals having the designated signal type according to the marking, to obtain an enhanced audio signal; and adding the enhanced audio signal into a decoding stream of the plurality of audio signals to obtain an audio decoding signal.

4. The method according to claim 3, wherein the designated signal type is an analogous audio signal, and wherein the step of performing the enhancement-process comprises:

performing a frequency-spectrum enhancement and an acoustic-image extension to the analogous audio signal.

5. The method according to claim 4, wherein the step of processing the frequency-spectrum enhancement to the analogous audio signal comprises:

obtaining a frequency of each audio signal;

determining a frequency-spectrum enhancement coefficient of each audio signal, according to the frequency of each audio signal; and performing the frequency-spectrum enhancement to each audio signal, according to the frequency-spectrum enhancement coefficient of each audio signal.

6. The method according to claim 4, wherein performing the acoustic-image extension to the analogous audio signal comprises:

using a delaying parameter to perform the acoustic-image extension to the analogous audio signal.

7. An audio decoding method, comprising:

obtaining an audio encoding stream to be decoded;

obtaining a plurality of audio signals that are continuous and an audio parameter of each audio signal, from the audio encoding stream;

determining whether each audio signal includes a designated signal type, including:

when the audio encoding stream includes a marking for each audio signal representing a type of the audio signal, determining whether each audio signal includes the designated signal type according to the marking; and when the audio encoding stream does not include the marking for each audio signal representing the type of the audio signal, determining whether each audio signal includes the designated signal type according to the audio parameter of each audio signal;

performing an enhancement-process to one or more audio signals having the designated signal type to obtain one or more enhanced audio signals; and adding the one or more enhanced audio signals into a decoding stream of the plurality of audio signals to obtain an audio decoding signal, wherein:

performing the enhancement-process to the one or more audio signals having the designated signal type comprises: performing a frequency-spectrum enhancement and an acoustic-image extension to the analogous audio signal, and the method further comprises:

for audio signals not having the designated signal type, directly performing a high frequency recovery and a stereo recovery; and for the one or more audio signals having the designated signal type, performing the high frequency recovery after the frequency spectrum enhancement, and performing the stereo recovery after the acoustic-image extension.

8. The method according to claim 7, wherein the designated signal type is an analogous audio signal, wherein the audio parameter of each audio signal comprises total frequency-spectrum energy, a spectral flatness measure (SFM), and a spectral flux (SF), and wherein the step of determining whether each audio signal includes the designated signal type comprises:

determining that an audio signal is the analogous audio signal, when the total frequency-spectrum energy of the audio signal is more than a first threshold value, the spectral flatness measure (SFM) is less than a second threshold value, and the spectral flux (SF) is more than a third threshold value.

9. The method according to claim 7, wherein the step of processing the frequency-spectrum enhancement to the analogous audio signal comprises:

obtaining a frequency of each audio signal;

determining a frequency-spectrum enhancement coefficient of each audio signal, according to the frequency of each audio signal; and performing the frequency-spectrum enhancement to each audio signal, according to the frequency-spectrum enhancement coefficient of each audio signal.

10. The method according to claim 7, wherein performing the acoustic-image extension to the analogous audio signal comprises:

using a delaying parameter to perform the acoustic-image extension to the analogous audio signal.

11. The method according to claim 7, wherein:

one bit is used to encode the marking representing the type for each audio signal in the audio encoding stream;

audio signals having the designated signal type is marked as 1, and audio signals not having the designated signal type is marked as 0.

12. An audio encoding apparatus, comprising at least one processor configured to:

obtain a plurality of audio signals that are continuous;

determine a type of each audio signal of the plurality of audio signals, according to an audio parameter of each audio signal, wherein the type of each audio signal is one of a designated signal type, a voice signal type, and a mute signal type; and perform a marking to each audio signal as having or not having the designated signal type to obtain a marked audio encoding stream, wherein the marking is used, when decoding, to perform an enhancement-process to one or more audio signals having the designated signal type, wherein the designated signal type is an analogous audio signal, and the at least one processor is further configured to:

obtain the audio parameter of each audio signal, wherein the audio parameter comprises logarithmic energy, a high-zero-crossing-rate-ratio (HZCRR), and a spectral flux (SF);

determine that an audio signal is the mute signal type, when the logarithmic energy of the audio signal is less than a first threshold value;

determine that an audio signal is the voice signal type, when the logarithmic energy of the audio signal is no less than the first threshold value, and the HZCRR is more than a second threshold value; and determine that an audio signal is the analogous audio signal, when the logarithmic energy of the audio signal is no less than the first threshold value, the HZCRR is no more than the second threshold value, and the spectral flux is more than a third threshold value.

13. The apparatus according to claim 12, wherein the designated signal type is an analogous audio signal.

14. The apparatus according to claim 12, the at least one processor is further configured to:

obtain the marked audio encoding stream;

obtain the plurality of audio signals from the audio encoding stream;

obtain the marking of at least a portion of the plurality of audio signals;

perform the enhancement-process to one or more audio signals having the designated signal type according to the marking, to obtain an enhanced audio signal; and add the enhanced audio signal into a decoding stream of the plurality of audio signals to obtain an audio decoding signal.

15. The apparatus according to claim 14, wherein the designated signal type is an analogous audio signal, and wherein the at least one processor is further configured to perform a frequency-spectrum enhancement and an acoustic-image extension to the analogous audio signal.

16. The apparatus according to claim 15, wherein the at least one processor is further configured to:

obtain a frequency of each audio signal;

determine a frequency-spectrum enhancement coefficient of each audio signal, according to the frequency of each audio signal; and perform the frequency-spectrum enhancement to each audio signal, according to the frequency-spectrum enhancement coefficient of each audio signal determined.

17. The apparatus according to claim 15, wherein the at least one processor is further configured to:

use a time delaying parameter to perform the acoustic-image extension to the analogous audio signal.

18. An audio decoding apparatus, comprising at least one processor configured to:

obtain an audio encoding stream to be decoded;

obtain, a plurality of audio signals that are continuous and an audio parameter of each audio signal, from the audio encoding stream;

determine whether each audio signal includes a designated signal type, including:

when the audio encoding stream includes a marking for each audio signal representing a type of the audio signal, determining whether each audio signal includes the designated signal type according to the marking; and when the audio encoding stream does not include the marking for each audio signal representing the type of the audio signal, determining whether each audio signal includes the designated signal type according to the audio parameter of each audio signal;

perform an enhancement-process to one or more audio signals having the designated signal type to obtain one or more enhanced audio signals; and add the one or more enhanced audio signals into a decoding stream of the plurality of audio signals to obtain an audio decoding signal, wherein the at least one processor is further configured to:

perform a frequency-spectrum enhancement and an acoustic-image extension to the analogous audio signal, for audio signals not having the designated signal type, directly perform a high frequency recovery and a stereo recovery; and for the one or more audio signals having the designated signal type, perform the high frequency recovery after the frequency spectrum enhancement, and perform the stereo recovery after the acoustic-image extension.

19. The apparatus according to claim 18, wherein the designated signal type is an analogous audio signal, wherein the audio parameter of each audio signal comprises total frequency-spectrum energy, a spectral flatness measure (SFM), and a spectral flux (SF), and wherein the at least one processor is further configured to determine that an audio signal is the analogous audio signal, when the total frequency-spectrum energy of the audio signal is more than a first threshold value, the spectral flatness measure (SFM)is less than a second threshold value, and the spectral flux(SF) is more than a third threshold value.

20. The apparatus according to claim 18, wherein the at least one processor is further configured to:

obtain a frequency of each audio signal;

determine a frequency-spectrum enhancement coefficient of each audio signal, according to the frequency of each audio signal; and perform the frequency-spectrum enhancement to each audio signal, according to the frequency-spectrum enhancement coefficient of each audio signal.

21. The apparatus according to claim 18, wherein the at least one processor is further configured to:

use a time delaying parameter to perform the acoustic-image extension to the analogous audio signal.

* * * * *